US008656817B2

(12) United States Patent
Fritz et al.

(10) Patent No.: US 8,656,817 B2
(45) Date of Patent: Feb. 25, 2014

(54) MULTI-PROFILE DIE CUTTING ASSEMBLY

(75) Inventors: Jeffrey W. Fritz, Plymouth, WI (US); Robert E. Andrews, Sheboygan, WI (US)

(73) Assignee: Curt G. Joa, Sheboygan Falls, WI (US)

( * ) Notice: Subject to any disclaimer, the term of this patent is extended or adjusted under 35 U.S.C. 154(b) by 176 days.

(21) Appl. No.: 13/414,431

(22) Filed: Mar. 7, 2012

(65) Prior Publication Data

US 2013/0061732 A1 Mar. 14, 2013

Related U.S. Application Data

(60) Provisional application No. 61/450,917, filed on Mar. 9, 2011.

(51) Int. Cl.
*B26D 1/56* (2006.01)

(52) U.S. Cl.
USPC ..... 83/305; 83/343; 83/356.3

(58) Field of Classification Search
USPC ..... 83/343, 356.3, 350, 347, 305, 284
See application file for complete search history.

(56) References Cited

U.S. PATENT DOCUMENTS

| | | | |
|---|---|---|---|
| 135,145 | A | 1/1873 | Murphy |
| 293,353 | A | 2/1884 | Purvis |
| 312,257 | A | 2/1885 | Cotton et al. |
| 410,123 | A | 8/1889 | Stilwell |
| 432,742 | A | 7/1890 | Stanley |
| 643,821 | A | 2/1900 | Howlett |
| 1,393,524 | A | 10/1921 | Grupe |
| 1,431,315 | A | 10/1922 | Le Moine |
| 1,605,842 | A | 11/1926 | Jones |
| 1,686,595 | A | 10/1928 | Belluche |
| 1,957,651 | A | 5/1934 | Joa |
| 2,009,857 | A | 7/1935 | Potdevin |
| 2,054,832 | A | 9/1936 | Potdevin |
| 2,117,432 | A | 5/1938 | Linscott |
| 2,128,746 | A | 8/1938 | Joa |
| 2,131,808 | A | 10/1938 | Joa |
| 2,164,408 | A | 7/1939 | Joa |
| 2,167,179 | A | 7/1939 | Joa |
| 2,171,741 | A | 9/1939 | Cohn et al. |
| 2,213,431 | A | 9/1940 | Joa |
| 2,254,290 | A | 9/1941 | Joa |
| 2,254,291 | A | 9/1941 | Joa |
| 2,282,477 | A | 5/1942 | Joa |
| 2,286,096 | A | 6/1942 | Joa |
| 2,296,931 | A | 9/1942 | Joa |

(Continued)

FOREIGN PATENT DOCUMENTS

| | | |
|---|---|---|
| BE | 1007854 | 11/1995 |
| CA | 1146129 | 5/1983 |

(Continued)

OTHER PUBLICATIONS

"Reciprocating Mechanisms", Franklin Jones, vol. 1, date unknown, 2 pages.

*Primary Examiner* — Sean Michalski
(74) *Attorney, Agent, or Firm* — Ryan Kromholz & Manion, S.C.

(57) ABSTRACT

A die roll is disclosing have multiple alternating patterns. Cutting edges and non-cutting edges on the die roll are phased with cutting surfaces and relieved areas on the anvil, respectively. Multiple cut profiles are achieved from a single die/anvil combination.

5 Claims, 7 Drawing Sheets

(56) References Cited

U.S. PATENT DOCUMENTS 2,304,571 A 12/1942 Joa
2,324,930 A 7/1943 Joa
2,345,937 A 4/1944 Joa
2,466,240 A 4/1949 Joa
2,481,929 A 9/1949 Joa
2,510,229 A 6/1950 Joa
2,540,844 A 2/1951 Strauss
2,584,002 A 1/1952 Elser et al.
2,591,359 A 4/1952 Joa
2,618,816 A 11/1952 Joa
2,627,859 A 2/1953 Hargrave
2,695,025 A 11/1954 Andrews
2,702,406 A 2/1955 Reed
2,721,554 A 10/1955 Joa
2,730,144 A 1/1956 Joa
2,772,611 A 12/1956 Heywood
2,780,253 A 2/1957 Joa
2,785,609 A 3/1957 Billeb
2,788,786 A 4/1957 Dexter
2,811,905 A 11/1957 Kennedy, Jr.
2,828,745 A 4/1958 Deutz
2,839,059 A 6/1958 Joa
2,842,169 A 7/1958 Joa
2,851,934 A 9/1958 Heywood
2,875,724 A 3/1959 Joa
2,890,700 A 6/1959 Lonberg-Holm
2,913,862 A 11/1959 Sabee
2,939,461 A 6/1960 Joa
2,939,646 A 6/1960 Stone
2,960,143 A 11/1960 Joa
2,990,081 A 6/1961 De Neui et al.
2,991,739 A 7/1961 Joa
3,016,207 A 1/1962 Comstock, III
3,016,582 A 1/1962 Joa
3,017,795 A 1/1962 Joa
3,020,687 A 2/1962 Joa
3,021,135 A 2/1962 Joa
3,024,957 A 3/1962 Pinto
3,053,427 A 9/1962 Wasserman
3,054,516 A 9/1962 Joa
3,069,982 A 12/1962 Heywood et al.
3,075,684 A * 1/1963 Rothmann ..... 229/237
3,086,253 A 4/1963 Joa
3,087,689 A 4/1963 Heim
3,089,494 A 5/1963 Schwartz
3,091,408 A 5/1963 Schoeneman
3,114,994 A 12/1963 Joa
3,122,293 A 2/1964 Joa
3,128,206 A 4/1964 Dungler
3,203,419 A 8/1965 Joa
3,230,955 A 1/1966 Joa
3,268,954 A 8/1966 Joa
3,288,037 A 11/1966 Burnett
3,289,254 A 12/1966 Joa
3,291,131 A 12/1966 Joa
3,301,114 A 1/1967 Joa
3,318,608 A 5/1967 Smrekar
3,322,589 A 5/1967 Joa
3,342,184 A 9/1967 Joa
3,356,092 A 12/1967 Joa
3,360,103 A 12/1967 Joa
3,363,847 A 1/1968 Joa
3,391,777 A 7/1968 Joa
3,454,442 A 7/1969 Heller, Jr.
3,463,413 A 8/1969 Smith
3,470,848 A 10/1969 Dreher
3,484,275 A 12/1969 Lewicki, Jr.
3,502,322 A 3/1970 Cran
3,521,639 A 7/1970 Joa
3,526,563 A 9/1970 Schott, Jr.
3,527,123 A * 9/1970 Dovey ..... 76/107.1
3,538,551 A 11/1970 Joa
3,540,641 A 11/1970 Besnyo
3,575,170 A 4/1971 Clark
3,607,578 A 9/1971 Berg et al.
3,635,462 A 1/1972 Joa
3,656,741 A 4/1972 Macke et al.
3,666,611 A 5/1972 Joa
3,673,021 A 6/1972 Joa
3,685,818 A 8/1972 Burger et al.
3,728,191 A 4/1973 Wierzba et al.
3,751,224 A 8/1973 Wackerle
3,758,102 A 9/1973 Munn et al.
3,762,542 A * 10/1973 Grimes ..... 206/525
3,772,120 A 11/1973 Radzins
3,776,798 A 12/1973 Milano
3,796,360 A 3/1974 Alexeff
3,811,987 A 5/1974 Wilkinson et al.
3,816,210 A 6/1974 Aoko et al.
3,847,710 A 11/1974 Blomqvist et al.
3,854,917 A 12/1974 McKinney et al.
3,883,389 A 5/1975 Schott, Jr.
3,888,400 A 6/1975 Wiig
3,901,238 A 8/1975 Geller et al.
3,903,768 A 9/1975 Amberg et al.
3,904,147 A 9/1975 Taitel et al.
3,918,698 A 11/1975 Coast
3,921,481 A * 11/1975 Fleetwood ..... 83/117
3,941,038 A * 3/1976 Bishop ..... 493/371
3,960,646 A 6/1976 Wiedamann
3,988,194 A 10/1976 Babcock et al.
3,991,994 A 11/1976 Farish
4,002,005 A 1/1977 Mueller et al.
4,003,298 A 1/1977 Schott, Jr.
4,009,626 A * 3/1977 Gressman ..... 83/116
4,009,814 A 3/1977 Singh
4,009,815 A 3/1977 Ericson et al.
4,053,150 A 10/1977 Lane
4,056,919 A 11/1977 Hirsch
4,081,301 A 3/1978 Buell
4,090,516 A 5/1978 Schaar
4,094,319 A 6/1978 Joa
4,103,595 A 8/1978 Corse
4,106,974 A 8/1978 Hirsch
4,108,584 A 8/1978 Radzins et al.
4,136,535 A 1/1979 Audas
4,141,193 A 2/1979 Joa
4,141,509 A 2/1979 Radzins
4,142,626 A 3/1979 Bradley
4,157,934 A 6/1979 Ryan et al.
4,165,666 A 8/1979 Johnson et al.
4,168,776 A 9/1979 Hoeboer
4,171,239 A 10/1979 Hirsch et al.
4,205,679 A 6/1980 Repke et al.
4,208,230 A 6/1980 Magarian
4,213,356 A 7/1980 Armitage
4,215,827 A 8/1980 Roberts et al.
4,222,533 A 9/1980 Pongracz
4,223,822 A 9/1980 Clitheroe
4,231,129 A 11/1980 Winch
4,236,955 A 12/1980 Prittie
4,275,510 A 6/1981 George
4,284,454 A 8/1981 Joa
4,307,800 A 12/1981 Joa
4,316,756 A 2/1982 Wilson
4,325,519 A 4/1982 McLean
4,342,206 A 8/1982 Rommel
4,349,140 A * 9/1982 Passafiume ..... 225/97
4,364,787 A 12/1982 Radzins
4,374,576 A 2/1983 Ryan
4,379,008 A 4/1983 Gross et al.
4,394,898 A 7/1983 Campbell
4,411,721 A 10/1983 Wishart
4,426,897 A * 1/1984 Littleton ..... 83/37
4,452,597 A 6/1984 Achelpohl
4,492,608 A 1/1985 Hirsch et al.
4,501,098 A 2/1985 Gregory
4,508,528 A 4/1985 Hirsch et al.
4,522,853 A 6/1985 Szonn et al.
4,543,152 A 9/1985 Nozaka
4,551,191 A 11/1985 Kock et al.
4,586,199 A 5/1986 Birring
4,589,945 A 5/1986 Polit
4,603,800 A 8/1986 Focke et al.

(56) References Cited

U.S. PATENT DOCUMENTS 4,608,115 A 8/1986 Schroth et al.
4,610,681 A 9/1986 Strohbeen et al.
4,610,682 A 9/1986 Kopp
4,614,076 A 9/1986 Rathemacher
4,619,357 A 10/1986 Radzins et al.
4,625,612 A * 12/1986 Oliver ..... 83/863
4,634,482 A 1/1987 Lammers
4,641,381 A 2/1987 Heran et al.
4,642,150 A 2/1987 Stemmler
4,642,839 A 2/1987 Urban
4,650,530 A 3/1987 Mahoney et al.
4,663,220 A 5/1987 Wisneski et al.
4,672,705 A 6/1987 Bors et al.
4,675,016 A 6/1987 Meuli et al.
4,675,062 A 6/1987 Instance
4,675,068 A 6/1987 Lundmark
4,686,136 A 8/1987 Homonoff et al.
4,693,056 A 9/1987 Raszewski
4,701,239 A 10/1987 Craig
4,720,415 A 1/1988 Vander Wielen et al.
4,723,698 A 2/1988 Schoonderbeek
4,726,874 A 2/1988 Van Vliet
4,726,876 A 2/1988 Tomsovic, Jr.
4,743,241 A 5/1988 Igaue et al.
4,751,997 A 6/1988 Hirsch
4,753,429 A 6/1988 Irvine et al.
4,756,141 A 7/1988 Hirsch et al.
4,764,325 A 8/1988 Angstadt
4,765,780 A 8/1988 Angstadt
4,776,920 A 10/1988 Ryan
4,777,513 A 10/1988 Nelson
4,782,647 A 11/1988 Williams et al.
4,785,986 A 11/1988 Daane et al.
4,795,451 A 1/1989 Buckley
4,795,510 A 1/1989 Wittrock et al.
4,798,353 A 1/1989 Peugh
4,801,345 A 1/1989 Dussaud et al.
4,802,570 A 2/1989 Hirsch et al.
4,840,609 A 6/1989 Jones et al.
4,845,964 A 7/1989 Bors et al.
4,864,802 A 9/1989 D'Angelo
4,880,102 A 11/1989 Indrebo
4,888,231 A 12/1989 Angstadt
4,892,536 A 1/1990 Des Marais et al.
4,904,440 A 2/1990 Angstadt
4,908,175 A 3/1990 Angstadt
4,909,019 A 3/1990 Delacretaz et al.
4,915,767 A 4/1990 Rajala et al.
4,917,746 A 4/1990 Kons et al.
4,925,520 A 5/1990 Beaudoin et al.
4,927,322 A 5/1990 Schweizer et al.
4,927,486 A 5/1990 Fattal et al.
4,927,582 A 5/1990 Bryson
4,937,887 A 7/1990 Schreiner
4,963,072 A 10/1990 Miley et al.
4,987,940 A 1/1991 Straub et al.
4,994,010 A 2/1991 Doderer-Winkler
5,000,806 A 3/1991 Merkatoris et al.
5,021,111 A 6/1991 Swenson
5,025,910 A 6/1991 Lasure et al.
5,029,505 A * 7/1991 Holliday ..... 83/652
5,045,039 A 9/1991 Bay
5,062,597 A 11/1991 Martin et al.
5,064,179 A 11/1991 Martin
5,064,492 A 11/1991 Friesch
5,080,741 A 1/1992 Nomura et al.
5,094,658 A 3/1992 Smithe et al.
5,096,532 A 3/1992 Neuwirth et al.
5,108,017 A 4/1992 Adamski, Jr. et al.
5,109,767 A 5/1992 Nyfeler et al.
5,110,403 A 5/1992 Ehlert
5,127,981 A 7/1992 Straub et al.
5,131,525 A 7/1992 Musschoot
5,131,901 A 7/1992 Moll
5,133,511 A 7/1992 Mack
5,147,487 A 9/1992 Nomura et al.
5,163,594 A 11/1992 Meyer
5,171,239 A 12/1992 Igaue et al.
5,176,244 A 1/1993 Radzins et al.
5,183,252 A 2/1993 Wolber et al.
5,188,627 A 2/1993 Igaue et al.
5,190,234 A 3/1993 Ezekiel
5,195,684 A 3/1993 Radzins
5,203,043 A 4/1993 Riedel
5,213,645 A 5/1993 Nomura et al.
5,222,422 A 6/1993 Benner, Jr. et al.
5,223,069 A 6/1993 Tokuno et al.
5,226,992 A 7/1993 Morman
5,246,433 A 9/1993 Hasse et al.
5,252,228 A 10/1993 Stokes
5,267,933 A 12/1993 Precoma
5,273,228 A 12/1993 Yoshida
5,275,076 A * 1/1994 Greenwalt ..... 83/698.31
5,275,676 A 1/1994 Rooyakkers et al.
5,308,345 A 5/1994 Herrin
5,328,438 A 7/1994 Crowley
5,340,424 A 8/1994 Matsushita
5,368,893 A 11/1994 Sommer et al.
5,389,173 A 2/1995 Merkatoris et al.
5,393,360 A 2/1995 Bridges et al.
5,407,507 A 4/1995 Ball
5,407,513 A 4/1995 Hayden et al.
5,410,857 A * 5/1995 Utley ..... 53/410
5,415,649 A 5/1995 Watanabe et al.
5,417,132 A * 5/1995 Cox et al. ..... 83/116
5,421,924 A 6/1995 Ziegelhoffer et al.
5,424,025 A 6/1995 Hanschen et al.
5,429,576 A 7/1995 Doderer-Winkler
5,435,802 A 7/1995 Kober
5,449,353 A 9/1995 Watanabe et al.
5,464,401 A 11/1995 Hasse et al.
5,486,253 A 1/1996 Otruba
5,494,622 A 2/1996 Heath et al.
5,500,075 A 3/1996 Herrmann
5,516,392 A 5/1996 Bridges et al.
5,518,566 A 5/1996 Bridges et al.
5,525,175 A 6/1996 Blenke et al.
5,531,850 A 7/1996 Herrmann
5,540,647 A 7/1996 Weiermann et al.
5,540,796 A 7/1996 Fries
5,545,275 A 8/1996 Herrin et al.
5,545,285 A 8/1996 Johnson
5,552,013 A 9/1996 Ehlert et al.
5,555,786 A * 9/1996 Fuller ..... 83/663
5,556,360 A 9/1996 Kober et al.
5,556,504 A 9/1996 Rajala et al.
5,560,793 A 10/1996 Ruscher et al.
5,575,187 A 11/1996 Dieterlen
5,586,964 A 12/1996 Chase
5,602,747 A 2/1997 Rajala
5,603,794 A 2/1997 Thomas
5,624,420 A 4/1997 Bridges et al.
5,624,428 A 4/1997 Sauer
5,628,738 A 5/1997 Suekane
5,634,917 A 6/1997 Fujioka et al.
5,636,500 A * 6/1997 Gould ..... 53/559
5,643,165 A 7/1997 Klekamp
5,643,396 A 7/1997 Rajala et al.
5,645,543 A 7/1997 Nomura et al.
5,659,229 A 8/1997 Rajala
5,660,657 A 8/1997 Rajala et al.
5,660,665 A 8/1997 Jalonen
5,683,376 A 11/1997 Kato et al.
5,683,531 A 11/1997 Roessler et al.
RE35,687 E 12/1997 Igaue et al.
5,693,165 A 12/1997 Schmitz
5,699,653 A 12/1997 Hartman et al.
5,705,013 A 1/1998 Nease
5,707,470 A 1/1998 Rajala et al.
5,711,832 A 1/1998 Glaug et al.
5,725,518 A 3/1998 Coates
5,725,714 A 3/1998 Fujioka
5,743,994 A 4/1998 Roessler et al.
5,745,922 A 5/1998 Rajala et al.

(56) References Cited

U.S. PATENT DOCUMENTS 5,746,869 A 5/1998 Hayden et al.
5,749,989 A 5/1998 Linman et al.
5,759,340 A 6/1998 Boothe et al.
5,766,389 A 6/1998 Brandon et al.
5,779,689 A 7/1998 Pfeifer et al.
5,788,797 A 8/1998 Herrin et al.
5,817,199 A 10/1998 Brennecke et al.
5,827,259 A 10/1998 Laux et al.
5,829,164 A 11/1998 Kotischke
5,836,931 A 11/1998 Toyoda et al.
5,858,012 A 1/1999 Yamaki et al.
5,865,393 A 2/1999 Kreft et al.
5,868,727 A 2/1999 Barr et al.
5,876,027 A 3/1999 Fukui et al.
5,876,792 A 3/1999 Caldwell
5,879,500 A 3/1999 Herrin et al.
5,902,431 A 5/1999 Wilkinson et al.
5,904,675 A 5/1999 Laux et al.
5,932,039 A 8/1999 Popp et al.
5,935,367 A * 8/1999 Hollenbeck ..... 156/252
5,938,193 A 8/1999 Bluemle et al.
5,938,652 A 8/1999 Sauer
5,964,390 A 10/1999 Borresen et al.
5,964,970 A 10/1999 Woolwine et al.
5,971,134 A 10/1999 Trefz et al.
5,983,764 A * 11/1999 Hillebrand ..... 83/305
6,009,781 A * 1/2000 McNeil ..... 83/37
6,022,443 A 2/2000 Rajala et al.
6,036,805 A 3/2000 McNichols
6,043,836 A 3/2000 Kerr et al.
6,050,517 A 4/2000 Dobrescu et al.
6,074,110 A 6/2000 Verlinden et al.
6,076,442 A 6/2000 Arterburn et al.
6,098,249 A 8/2000 Toney et al.
6,123,792 A 9/2000 Samida et al.
6,142,048 A * 11/2000 Bradatsch et al. ..... 83/341
6,171,432 B1 1/2001 Brisebois
6,183,576 B1 2/2001 Couillard et al.
6,193,054 B1 2/2001 Henson et al.
6,193,702 B1 2/2001 Spencer
6,195,850 B1 3/2001 Melbye et al.
6,210,386 B1 4/2001 Inoue
6,212,859 B1 4/2001 Bielik, Jr. et al.
6,214,147 B1 4/2001 Mortellite et al.
6,250,048 B1 6/2001 Linkiewicz
6,264,639 B1 7/2001 Sauer
6,264,784 B1 7/2001 Menard et al.
6,276,421 B1 8/2001 Valenti et al.
6,276,587 B1 8/2001 Boerresen
6,280,373 B1 * 8/2001 Lanvin ..... 493/227
6,284,081 B1 9/2001 Vogt et al.
6,287,409 B1 9/2001 Stephany
6,305,260 B1 * 10/2001 Truttmann et al. ..... 83/52
6,306,122 B1 10/2001 Narawa et al.
6,309,336 B1 10/2001 Muessig et al.
6,312,420 B1 11/2001 Sasaki et al.
6,314,333 B1 11/2001 Rajala et al.
6,315,022 B1 11/2001 Herrin et al.
6,319,347 B1 11/2001 Rajala
6,336,921 B1 1/2002 Kato et al.
6,336,922 B1 1/2002 VanGompel et al.
6,336,923 B1 1/2002 Fujioka et al.
6,358,350 B1 3/2002 Glaug et al.
6,369,291 B1 4/2002 Uchimoto et al.
6,375,769 B1 4/2002 Quereshi et al.
6,391,013 B1 5/2002 Suzuki et al.
6,416,697 B1 7/2002 Venturino et al.
6,431,038 B2 * 8/2002 Couturier ..... 83/34
6,440,246 B1 8/2002 Vogt et al.
6,443,389 B1 9/2002 Palone
6,446,795 B1 9/2002 Allen et al.
6,473,669 B2 10/2002 Rajala et al.
6,475,325 B1 11/2002 Parrish et al.
6,478,786 B1 11/2002 Glaug et al.
6,482,278 B1 11/2002 McCabe et al.
6,494,244 B2 12/2002 Parrish et al.
6,514,233 B1 2/2003 Glaug
6,521,320 B2 2/2003 McCabe et al.
6,523,595 B1 2/2003 Milner et al.
6,524,423 B1 2/2003 Hilt et al.
6,533,879 B2 3/2003 Quereshi et al.
6,540,857 B1 4/2003 Coenen et al.
6,547,909 B1 4/2003 Butterworth
6,551,228 B1 4/2003 Richards
6,551,430 B1 4/2003 Glaug et al.
6,554,815 B1 4/2003 Umebayashi
6,569,275 B1 5/2003 Popp et al.
6,572,520 B2 6/2003 Blumle
6,581,517 B1 6/2003 Becker et al.
6,585,841 B1 7/2003 Popp et al.
6,589,149 B1 7/2003 VanEperen et al.
6,596,107 B2 7/2003 Stopher
6,596,108 B2 7/2003 McCabe
6,605,172 B1 8/2003 Anderson et al.
6,605,173 B2 8/2003 Glaug et al.
6,634,269 B2 * 10/2003 Eckstein et al. ..... 83/100
6,637,583 B1 10/2003 Anderson
6,648,122 B1 11/2003 Hirsch et al.
6,649,010 B2 11/2003 Parrish et al.
6,656,309 B1 12/2003 Parker et al.
6,659,150 B1 12/2003 Perkins et al.
6,659,991 B2 12/2003 Suckane
6,675,552 B2 1/2004 Kunz et al.
6,682,626 B2 1/2004 Mlinar et al.
6,684,925 B2 2/2004 Nagate et al.
6,722,494 B2 4/2004 Nakakado
6,730,189 B1 5/2004 Franzmann
6,743,324 B2 6/2004 Hargett et al.
6,750,466 B2 6/2004 Guha et al.
6,758,109 B2 7/2004 Nakakado
6,766,817 B2 7/2004 da Silva
6,779,426 B1 * 8/2004 Holliday ..... 83/13
6,808,582 B2 10/2004 Popp et al.
D497,991 S 11/2004 Otsubo et al.
6,814,217 B2 11/2004 Blumenthal et al.
6,820,671 B2 11/2004 Calvert
6,837,840 B2 1/2005 Yonekawa et al.
6,840,616 B2 1/2005 Summers
6,852,186 B1 2/2005 Matsuda et al.
6,869,494 B2 3/2005 Roessler et al.
6,875,202 B2 4/2005 Kumasaka et al.
6,884,310 B2 4/2005 Roessler et al.
6,893,528 B2 5/2005 Middelstadt et al.
6,913,718 B2 7/2005 Ducker
6,918,404 B2 7/2005 Dias da Silva
6,976,521 B2 12/2005 Mlinar
6,978,486 B2 12/2005 Zhou et al.
7,017,321 B2 3/2006 Salvoni
7,017,820 B1 3/2006 Brunner
7,045,031 B2 5/2006 Popp et al.
7,047,852 B2 5/2006 Franklin et al.
7,066,586 B2 6/2006 da Silva
7,069,970 B2 7/2006 Tomsovic et al.
7,077,393 B2 7/2006 Ishida
7,130,710 B2 10/2006 Popp et al.
7,172,666 B2 2/2007 Groves et al.
7,175,584 B2 2/2007 Maxton et al.
7,195,684 B2 3/2007 Satoh
7,201,345 B2 4/2007 Werner
7,214,174 B2 5/2007 Allen et al.
7,214,287 B2 5/2007 Shiomi et al.
7,220,335 B2 5/2007 Van Gompel et al.
7,247,219 B2 7/2007 O'Dowd
7,252,730 B2 8/2007 Hoffman et al.
7,264,686 B2 9/2007 Thorson et al.
7,303,708 B2 12/2007 Andrews et al.
7,326,311 B2 2/2008 Krueger et al.
7,332,459 B2 2/2008 Collins et al.
7,380,213 B2 5/2008 Pesin et al.
7,398,870 B2 7/2008 McCabe
7,449,084 B2 11/2008 Nakakado
7,452,436 B2 11/2008 Andrews
7,533,709 B2 5/2009 Meyer
7,537,215 B2 5/2009 Beaudoin et al.

(56) References Cited

U.S. PATENT DOCUMENTS

| | | | | |
|---|---|---|---|---|
| 7,587,966 | B2 | 9/2009 | Nakakado et al. | |
| 7,618,513 | B2 | 11/2009 | Meyer | |
| 7,638,014 | B2 | 12/2009 | Coose et al. | |
| 7,640,962 | B2 | 1/2010 | Meyer et al. | |
| 7,703,599 | B2 | 4/2010 | Meyer | |
| 7,708,849 | B2 | 5/2010 | McCabe | |
| 7,770,712 | B2 | 8/2010 | McCabe | |
| 7,771,407 | B2 | 8/2010 | Umebayashi | |
| 7,780,052 | B2 | 8/2010 | McCabe | |
| 7,793,772 | B2 | 9/2010 | Schafer | |
| 7,811,403 | B2 | 10/2010 | Andrews | |
| 7,861,756 | B2 | 1/2011 | Jenquin et al. | |
| 7,871,400 | B2 | 1/2011 | Sablone et al. | |
| 7,909,956 | B2 | 3/2011 | Coose et al. | |
| 7,935,296 | B2 | 5/2011 | Koele et al. | |
| 7,975,584 | B2 | 7/2011 | McCabe | |
| 7,987,964 | B2 | 8/2011 | McCabe | |
| 8,007,484 | B2 | 8/2011 | McCabe et al. | |
| 8,007,623 | B2 | 8/2011 | Andrews | |
| 8,011,493 | B2 | 9/2011 | Giuliani et al. | |
| 8,016,972 | B2 | 9/2011 | Andrews et al. | |
| 8,062,459 | B2 | 11/2011 | Nakakado et al. | |
| 8,176,573 | B2 | 5/2012 | Popp et al. | |
| 8,381,489 | B2 * | 2/2013 | Freshwater et al. | 52/748.1 |
| 2001/0012813 | A1 | 8/2001 | Bluemle | |
| 2001/0017181 | A1 | 8/2001 | Otruba et al. | |
| 2001/0035332 | A1 | 11/2001 | Zeitler | |
| 2001/0042591 | A1 | 11/2001 | Milner et al. | |
| 2002/0040630 | A1 * | 4/2002 | Piazza | 83/13 |
| 2002/0046802 | A1 | 4/2002 | Tachibana et al. | |
| 2002/0059013 | A1 | 5/2002 | Rajala et al. | |
| 2002/0096241 | A1 | 7/2002 | Instance | |
| 2002/0125105 | A1 | 9/2002 | Nakakado | |
| 2002/0162776 | A1 | 11/2002 | Hergeth | |
| 2003/0000620 | A1 | 1/2003 | Herrin et al. | |
| 2003/0015209 | A1 | 1/2003 | Gingras et al. | |
| 2003/0051802 | A1 | 3/2003 | Hargett et al. | |
| 2003/0052148 | A1 | 3/2003 | Rajala et al. | |
| 2003/0066585 | A1 | 4/2003 | McCabe | |
| 2003/0083638 | A1 | 5/2003 | Molee | |
| 2003/0084984 | A1 | 5/2003 | Glaug et al. | |
| 2003/0089447 | A1 | 5/2003 | Molee et al. | |
| 2003/0115660 | A1 | 6/2003 | Hopkins | |
| 2003/0121614 | A1 | 7/2003 | Tabor et al. | |
| 2003/0135189 | A1 | 7/2003 | Umebayashi | |
| 2004/0007328 | A1 | 1/2004 | Popp et al. | |
| 2004/0016500 | A1 | 1/2004 | Tachibana et al. | |
| 2004/0044325 | A1 | 3/2004 | Corneliusson | |
| 2004/0087425 | A1 | 5/2004 | Ng et al. | |
| 2004/0098791 | A1 | 5/2004 | Faulks | |
| 2004/0112517 | A1 | 6/2004 | Groves et al. | |
| 2004/0164482 | A1 | 8/2004 | Edinger | |
| 2004/0177737 | A1 * | 9/2004 | Adami | 83/508.1 |
| 2004/0182213 | A1 * | 9/2004 | Wagner et al. | 83/343 |
| 2004/0182497 | A1 | 9/2004 | Lowrey | |
| 2004/0216830 | A1 | 11/2004 | Van Eperen | |
| 2005/0000628 | A1 | 1/2005 | Norrby | |
| 2005/0022476 | A1 | 2/2005 | Hamer | |
| 2005/0077418 | A1 | 4/2005 | Werner et al. | |
| 2005/0139713 | A1 | 6/2005 | Weber et al. | |
| 2005/0196538 | A1 | 9/2005 | Sommer et al. | |
| 2005/0230056 | A1 | 10/2005 | Meyer et al. | |
| 2005/0230449 | A1 | 10/2005 | Meyer et al. | |
| 2005/0233881 | A1 | 10/2005 | Meyer | |
| 2005/0234412 | A1 | 10/2005 | Andrews et al. | |
| 2005/0257881 | A1 | 11/2005 | Coose et al. | |
| 2005/0275148 | A1 | 12/2005 | Beaudoin et al. | |
| 2006/0011030 | A1 * | 1/2006 | Wagner et al. | 83/343 |
| 2006/0021300 | A1 | 2/2006 | Tada et al. | |
| 2006/0137298 | A1 | 6/2006 | Oshita et al. | |
| 2006/0201619 | A1 | 9/2006 | Andrews | |
| 2006/0224137 | A1 | 10/2006 | McCabe et al. | |
| 2006/0265867 | A1 | 11/2006 | Schaap | |
| 2007/0074953 | A1 | 4/2007 | McCabe | |
| 2008/0041206 | A1 * | 2/2008 | Mergola et al. | 83/343 |
| 2008/0210067 | A1 | 9/2008 | Schlinz et al. | |
| 2008/0223537 | A1 | 9/2008 | Wiedmann | |
| 2009/0020211 | A1 | 1/2009 | Andrews et al. | |
| 2009/0198205 | A1 | 8/2009 | Malowaniec et al. | |
| 2010/0078119 | A1 | 4/2010 | Yamamoto | |
| 2010/0078120 | A1 | 4/2010 | Otsubo | |
| 2010/0078127 | A1 | 4/2010 | Yamamoto et al. | |
| 2010/0193135 | A1 | 8/2010 | Eckstein et al. | |
| 2010/0193138 | A1 | 8/2010 | Eckstein et al. | |
| 2010/0193155 | A1 | 8/2010 | Nakatani et al. | |
| 2012/0123377 | A1 | 5/2012 | Back | |
| 2012/0285306 | A1 * | 11/2012 | Weibelt | 83/86 |

FOREIGN PATENT DOCUMENTS

| | | | |
|---|---|---|---|
| CA | 1153345 | | 9/1983 |
| CA | 1190078 | | 7/1985 |
| CA | 1210744 | | 9/1986 |
| CA | 1212132 | | 9/1986 |
| CA | 1236056 | | 5/1988 |
| CA | 1249102 | | 1/1989 |
| CA | 1292201 | | 11/1991 |
| CA | 1307244 | | 9/1992 |
| CA | 1308015 | | 9/1992 |
| CA | 1310342 | | 11/1992 |
| CA | 2023816 | | 3/1994 |
| CA | 2330679 | | 9/1999 |
| CA | 2404154 | | 10/2001 |
| CA | 2541194 | | 10/2006 |
| CA | 2559517 | | 4/2007 |
| CA | 2337700 | | 8/2008 |
| CA | 2407867 | | 6/2010 |
| CA | 2699136 | | 10/2010 |
| DE | 60123502 | | 10/2006 |
| DE | 60216550 | | 12/2006 |
| DE | 102005048868 | | 4/2007 |
| DE | 102006047280 | | 4/2007 |
| EP | 0044206 | | 1/1982 |
| EP | 0048011 | | 3/1982 |
| EP | 0089106 | | 9/1983 |
| EP | 0099732 | | 2/1984 |
| EP | 0206208 | | 12/1986 |
| EP | 0304140 | | 2/1989 |
| EP | 0439897 | | 8/1991 |
| EP | 0455231 | A1 | 11/1991 |
| EP | 510251 | | 10/1992 |
| EP | 0652175 | A1 | 5/1995 |
| EP | 0811473 | | 12/1997 |
| EP | 0901780 | | 3/1999 |
| EP | 0990588 | | 4/2000 |
| EP | 1132325 | A2 | 9/2001 |
| EP | 1035818 | | 4/2002 |
| EP | 1199057 | | 4/2002 |
| EP | 1272347 | | 1/2003 |
| EP | 1366734 | | 12/2003 |
| EP | 1571249 | | 9/2005 |
| EP | 1619008 | | 1/2006 |
| EP | 1707168 | A2 | 10/2006 |
| EP | 1726414 | | 11/2006 |
| EP | 1302424 | | 12/2006 |
| EP | 1801045 | | 6/2007 |
| EP | 1941853 | | 7/2008 |
| EP | 2233116 | | 9/2010 |
| EP | 2238955 | | 10/2010 |
| EP | 1175880 | | 5/2012 |
| ES | 509706 | | 11/1982 |
| ES | 520559 | | 12/1983 |
| ES | 296211 | | 12/1987 |
| ES | 200601373 | | 7/2009 |
| ES | 2311349 | | 9/2009 |
| FR | 2177355 | | 11/1973 |
| FR | 2255961 | | 7/1975 |
| FR | 1132325 | | 10/2006 |
| FR | 2891811 | | 4/2007 |
| GB | 191101501 | A | 0/1912 |
| GB | 439897 | | 12/1935 |
| GB | 856389 | | 12/1960 |
| GB | 941073 | | 11/1963 |
| GB | 1096373 | | 12/1967 |

(56) References Cited

FOREIGN PATENT DOCUMENTS

| | | | |
|---|---|---|---|
| GB | 1126539 | | 9/1968 |
| GB | 1346329 | | 2/1974 |
| GB | 1412812 | | 11/1975 |
| GB | 2045298 | | 10/1980 |
| GB | 2115775 | | 9/1983 |
| GB | 2288316 | | 10/1995 |
| IT | 1374910 | | 5/2010 |
| IT | 1374911 | | 5/2010 |
| JP | 428364 | | 1/1992 |
| JP | 542180 | | 2/1993 |
| JP | 576566 | | 3/1993 |
| JP | 626160 | | 2/1994 |
| JP | 626161 | | 2/1994 |
| JP | 6197925 | A | 7/1994 |
| JP | 9299398 | | 11/1997 |
| JP | 10035621 | | 2/1998 |
| JP | 10-277091 | A | 10/1998 |
| SE | 0602047 | | 5/2007 |
| SE | 0601003-7 | | 6/2007 |
| SE | 0601145-6 | | 10/2009 |
| WO | WO9403301 | | 2/1994 |
| WO | WO97/23398 | | 7/1997 |
| WO | WO9732552 | | 9/1997 |
| WO | WO9747265 | | 12/1997 |
| WO | WO9747810 | | 12/1997 |
| WO | WO9821134 | | 5/1998 |
| WO | WO9907319 | | 2/1999 |
| WO | WO9913813 | A1 | 3/1999 |
| WO | WO9932385 | | 7/1999 |
| WO | WO9965437 | | 12/1999 |
| WO | WO0143682 | | 6/2001 |
| WO | WO0172237 | A2 | 10/2001 |
| WO | WO03/031177 | | 4/2003 |
| WO | WO2004007329 | | 1/2004 |
| WO | WO2005075163 | | 8/2005 |
| WO | WO2006038946 | | 4/2006 |
| WO | WO2007029115 | | 3/2007 |
| WO | WO2007039800 | | 4/2007 |
| WO | WO2007126347 | | 11/2007 |
| WO | WO2008001209 | | 1/2008 |
| WO | WO2008037281 | | 4/2008 |
| WO | WO2008/123348 | | 10/2008 |
| WO | WO2008155618 | | 12/2008 |
| WO | WO2010028786 | | 3/2010 |
| WO | WO2011101773 | | 8/2011 |

* cited by examiner

MULTI-PROFILE DIE CUTTING ASSEMBLY

RELATED APPLICATION

This application claims the benefit of co-pending U.S. Provisional Patent Application Ser. No. 61/450,917, filed 9 Mar. 2011.

BACKGROUND OF THE INVENTION

The present invention relates to disposable hygiene products and more specifically, to methods and apparatuses for processing disposable hygiene products. More specifically, the invention relates to cutting and applying segments of one web to attach to a disposable diaper. Various types of automatic manufacturing equipment have been developed which produce the desired results with a variety of materials and configurations.

When manufacturing hygiene products, such as baby diapers, adult diapers, disposable undergarments, incontinence devices, sanitary napkins and the like, a common method of applying discrete pieces of one web to another is by use of a slip-and-cut applicator. A slip-and-cut applicator is typically comprised of a cylindrical rotating vacuum anvil, a rotating knife roll, and a transfer device. In typical applications, an incoming web is fed at a relatively low speed along the vacuum face of the rotating anvil, which is moving at a relatively higher surface speed and upon which the incoming web is allowed to "slip". A knife-edge, mounted on the rotating knife roll, cuts a off a segment of the incoming web against the anvil face. This knife-edge is preferably moving at a surface velocity similar to that of the anvil's surface. Once cut, the web segment is held by vacuum drawn through holes on the anvil's face as it is carried at the anvil's speed downstream to the transfer point where the web segment is transferred to the traveling web.

Typical vacuum rolls used in the prior art have rows of vacuum holes which are fed by cross-drilled ports, each being exposed to the source of vacuum by commutations, as the ports move into a zone of negative pressure in a stationary manifold. Such a configuration serves to apply vacuum sequentially to each successive row of holes.

A common problem associated with slip-and-cut applicators occurs at the point of cut. Since the web being cut is traveling at a very low velocity compared to the anvil and knife velocity (perhaps 1/20th), the engagement of the knife with infeeding web tends to induce a high tensile stress in the infeeding web. Having been placed under such a high level of stress, the infeeding web can recoil violently when the cut is finally completed, causing loss of control of the infeeding web. This "snap-back" effect increases with the thickness of the infeeding web. Thicker webs tend to prolong the duration of engagement with the knife before completion of the cut, thereby increasing the build-up of stress. This is a common process problem that is usually addressed by the provision of various shock-absorbing devices. One possible solution might have been to reduce the surface velocity of the knife, but substantially different velocities between the knife and anvil result in rapid wear of the knife edge and/or anvil face, depending on relative hardness.

Continual improvements and competitive pressures have incrementally increased the operational speeds of disposable diaper converters. As speeds increased, the mechanical integrity and operational capabilities of the applicators had to be improved accordingly.

Slip-and-cut apparatus are well known for their ability to cut relatively short segments of one web and place them accurately on another, higher speed web. Certain materials, however, behave badly in these applications. The tension pulsation caused by the cutting may cause the material to snap back, losing its natural track down the moving surface of the anvil roll. This is especially common with thick webs. Other materials, such as nonwoven fabrics, may be difficult to control because they are very porous and provide little resistance to air flow to keep the material on track. Still other materials, such as certain perforated films may possess texture qualities which tend to be very unstable on the anvil surface, acting instead like a puck on an air hockey table.

These problems are further exacerbated by using materials with a very low modulus of elasticity. Here, even very low levels of vacuum at the anvil surface may cause the material to stretch with the advancing movement of the anvil. The sudden change of tension seen when the knife cuts this over-stretched web can result in severe snap-back and complete loss of position, relative to the intended centerline. Likewise, webs with very high moduli may snap back violently when the web is cut.

The prior art is quite successful when processing full-width or symmetrical webs, which are drawn uniformly forward by the sliding vacuum surface on which they are held. Attempts to process asymmetrical webs on such a surface are less successful, as the draw of the advancing vacuum pattern will act differently on parts of the web which have differing lines of tension. For instance, a die-cut ear web for a disposable diaper may have only a narrow continuous portion along one edge, with the opposite edge being more or less scalloped in shape.

Current die designs allow for only one cut profile per die/anvil combination. It would be desirable for multiple cut profiles to be possible with a single die/anvil combination.

SUMMARY OF THE INVENTION

By providing multiple patterns on a die roll and phasing a non-cutting edge to a relieved area on the anvil, multiple cut profiles are achieved from a single set of tooling. It is therefore an object of this invention to provide an apparatus which can maintain control over die cut web sections of various shapes.

Longer or shorter ear profiles could also be created by varying material feed rate.

In a typical configuration of an ear cutting die/anvil combination, there is a pattern of vacuum holes distributed to evenly draw the entering web onto the anvil's surface and thence into a cut point where a knife edge engages an anvil, thus severing the web into discrete segments if so desired. The invention provides a generally cylindrical anvil body connected to a source of vacuum. The anvil roll has a plurality of ear retaining portions on its outer surface. This ear retaining portion is formed with a plurality of vacuum holes. The anvil roll is utilized in connection with a rotary multi pattern die to cut small segments of an incoming web. The anvil roll then transfers those cut segments to an additional web.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
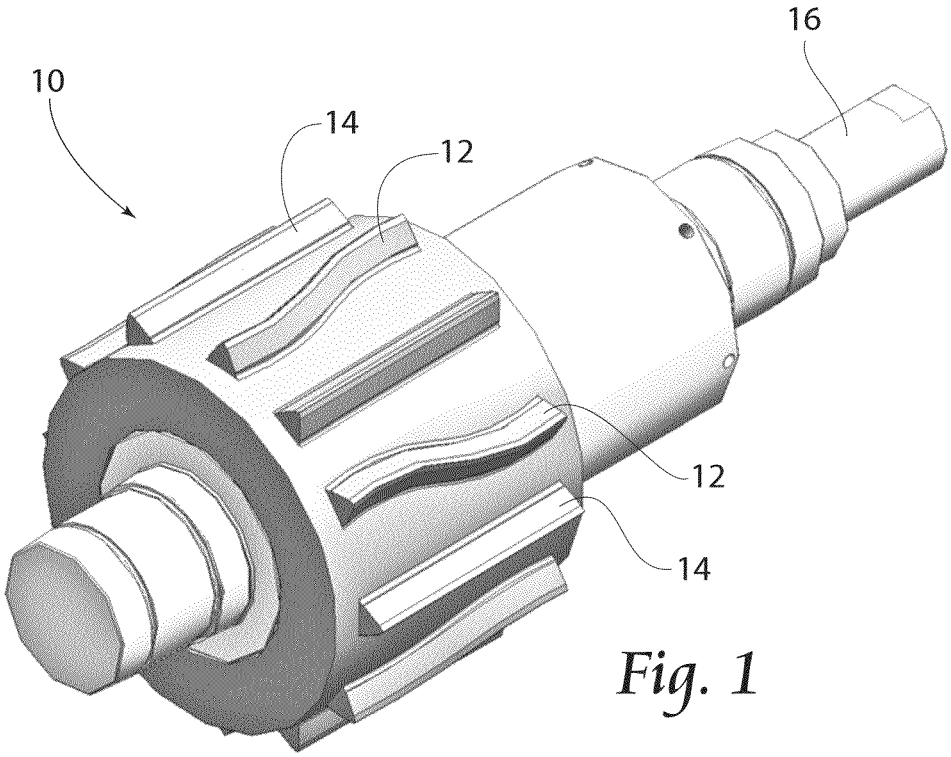
FIG. 1 is a perspective view of a multi-pattern die of the present invention.

Referring now to FIG. 1, a perspective view of a multi-pattern die 10 of the present invention is shown. The die 10 is rotated by shaft 16 (preferably servo-motor driven, shown diagrammatically to the right of the die 10 and anvil 50 on FIG. 3) and blades, both curved blades 12, and straight blades 14, can be used in cooperation with a complimentary vacuum anvil 50 (FIG. 2) to sever portions of an incoming web (see, e.g., FIGS. 5 and 6) into any shape of ear pattern.

It is noted that the die 10 as shown in FIG. 1 comprises alternating cutting shapes, between curved, straight, and complimentary curved, straight, curved, etc. By providing multiple patterns on a die roll and phasing a non-cutting edge to a relieved area on the anvil (FIG. 2), multiple cut profiles can be achieved from a single set of tooling. An infinite number of varying cut patterns can be provided on the die 10 to provide different cut profiles.

Figure 2:
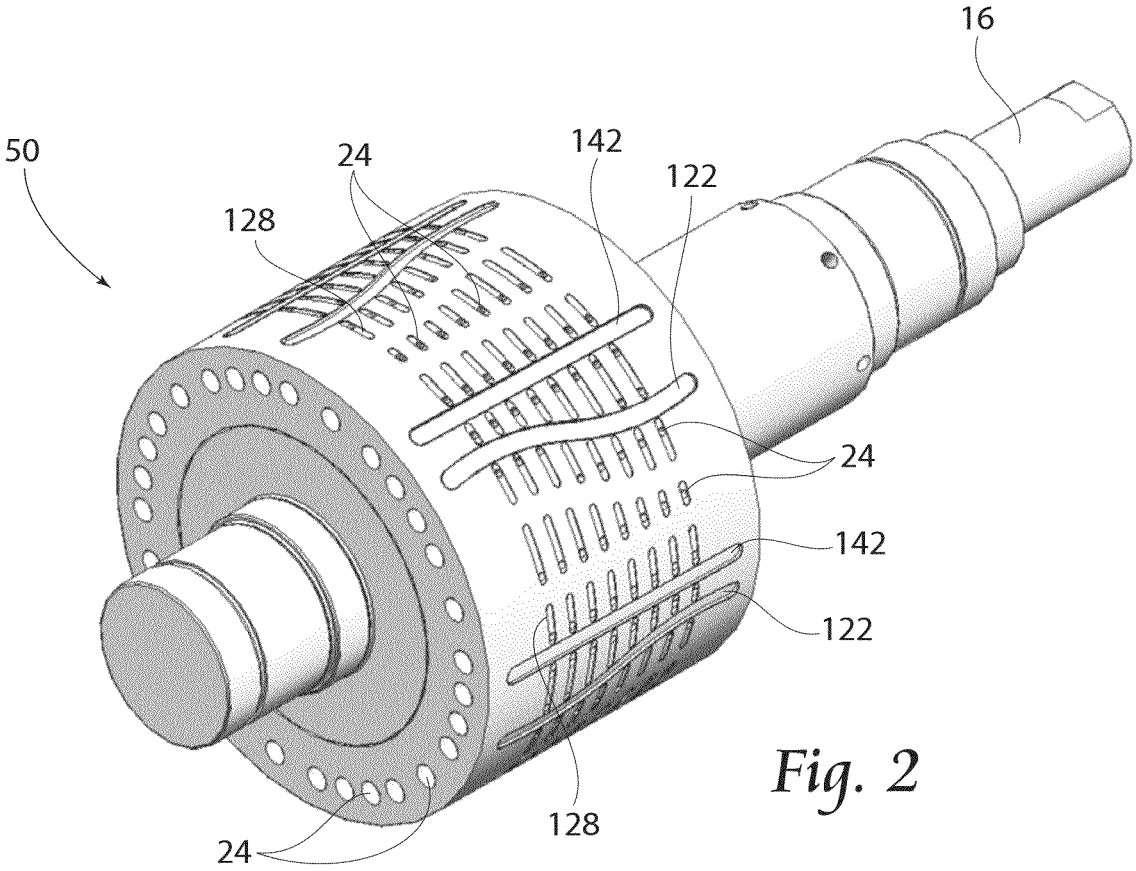
FIG. 2 is a perspective view of a vacuum anvil of the present invention.

Referring now to FIG. 2, a perspective view of a rotatable vacuum anvil 50 of the present invention is shown. When a curved ear pattern is desired (e.g., FIG. 5), curved blades 12 are employed against outer surfaces of the anvil 50, while the straight blades 14 are unemployed because they will be matched up with recessed portions 142 of the anvil 50 and therefore ineffectual.

When a straight ear pattern is desired (e.g., FIG. 6), straight blades 14 are employed against outer surfaces of the anvil 50, while the curved blades 12 are unemployed because they will be matched up with recessed portions 122 of the anvil 50 and therefore ineffectual.

The vacuum anvil 50 is driven by shaft 50 (preferably servo motor driven) and has vacuum commutation ports 24 to couple with a source of vacuum (not shown) during selected periods of rotation to apply vacuum to the radial surface ports 24 in shaped channels or vacuum slots 128. The radial surface ports apply vacuum to secure ear web material (shown later) to the surface of the vacuum anvil 50 during rotation of the vacuum anvil 50.

Figure 3:
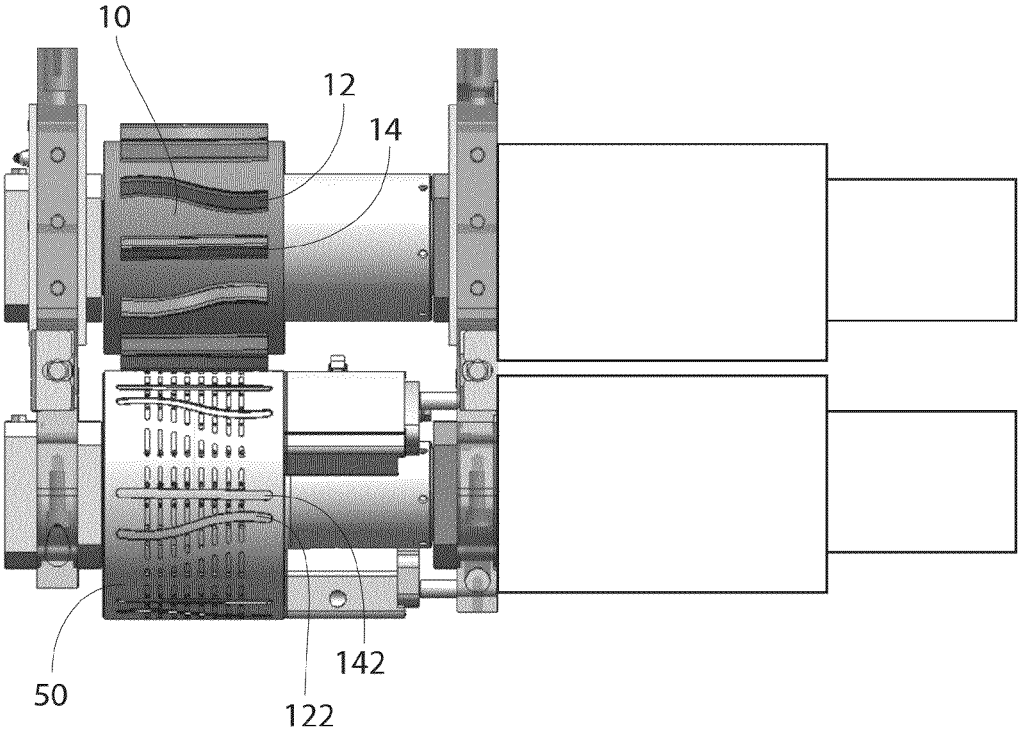
FIG. 3 is a side view of the die/anvil roll of the present invention.

Referring now to FIGS. 2 and 3, several patterns are evident on the radial surface of the vacuum anvil 50 to interact with the cutting blades 12 and 14 of the multi pattern die 10. First, a series of recessed straight non-cutting channels 142 and recessed curved non-cutting channels 122 are shown on the vacuum anvil 50, which can loosely receive mated cutting blades 12 and 14 of the multi pattern die 10 during operation.

Figure 4:
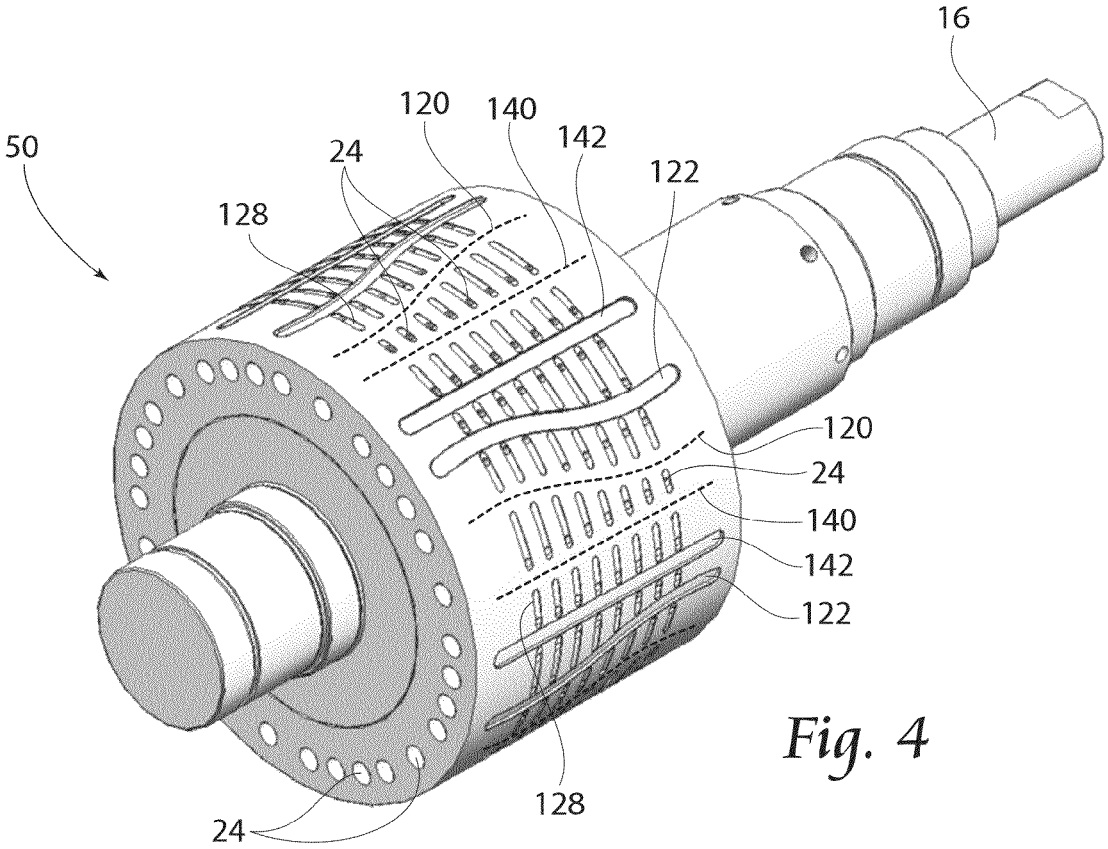
FIG. 4 is a perspective view of the anvil roll of the present invention, with possible cutting zones delineated.
Figure 5:
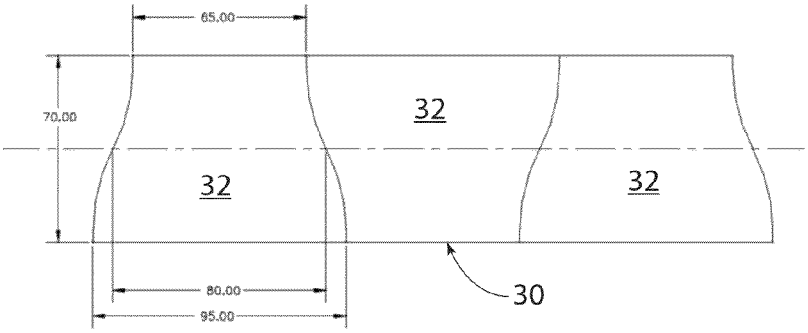
FIG. 5 is a plan view of a shaped ear profile cut by one of the pattern options of the die of the present invention.
Figure 6:
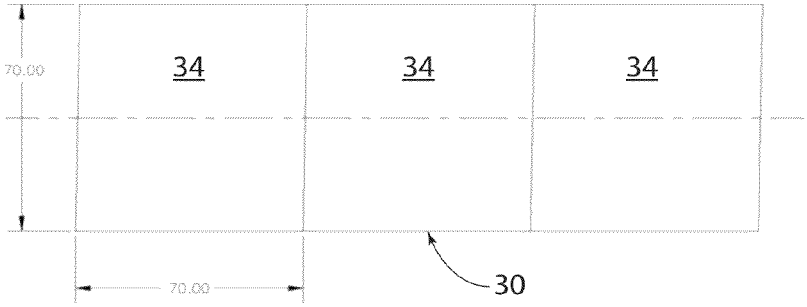
FIG. 6 is a plan view of a square ear profile cut by one of the pattern options of the die of the present invention.

Referring to FIG. 4, a perspective view of the vacuum anvil roll 50 of the present invention is shown. Curved cutting surfaces 120, and straight cutting surfaces 140 are possible cutting zones delineated. In use, an operator will select between a plurality of possible cutting patterns, for instance the curved (shaped) ear pattern 32 formed from web 30 as shown in FIG. 5, or the straight pattern 34 shown in FIG. 6. The multiple patterns as shown in FIGS. 5 and 6 are a result of the multiple blade patterns of the die 10 as shown in FIG. 1.

If a curved or shaped ear pattern 32 is desired (FIG. 5), the anvil/die combination will be phased such that the curved blades 12 of the die 10 are aligned with the curved cutting surfaces 120 of the anvil 50. This will result, because of the complimentary shaping of the blades 12 and 14 with the recessed curved and straight non-cutting channels 122 and 142, respectively, in the straight blades 14 being loosely mated in the recessed straight non-cutting channels 142. No cut is effectuated in the web 30 by the straight blades 14 in the area of the loose mating of the straight blades 14 and the recessed straight non-cutting channels 142, because the blades 14 do not have a surface on the vacuum anvil on which to contact to force a cut against. During manufacture of the curved or shaped ear pattern 32, it is noted that the recessed curved non-cutting channel will remain unoccupied.

If a straight ear pattern 34 is desired (FIG. 6), the anvil/die combination will be phased such that the straight blades 14 of the die 10 are aligned with the straight cutting surfaces 140 of the anvil 50. This will result, because of the complimentary shaping of the blades 12 and 14 with the recessed curved and straight non-cutting channels 122 and 142, respectively, in the curved blades 12 being loosely mated in the recessed curved non-cutting channels 122. No cut is effectuated in the web 30 in the area of the loose mating of the curved blades 12 and the recessed curved non-cutting channels 122, because the blades 12 do not have a surface on the vacuum anvil on which to contact to force a cut against.

Figure 7:
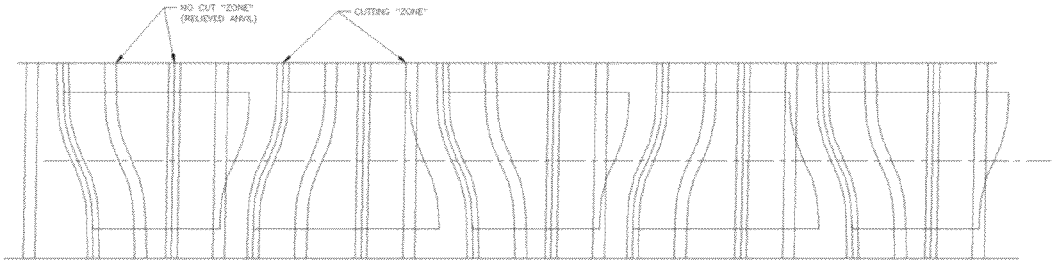
FIG. 7 is a plan view of shaped ear die phasing of a die of the present invention.
Figure 8:
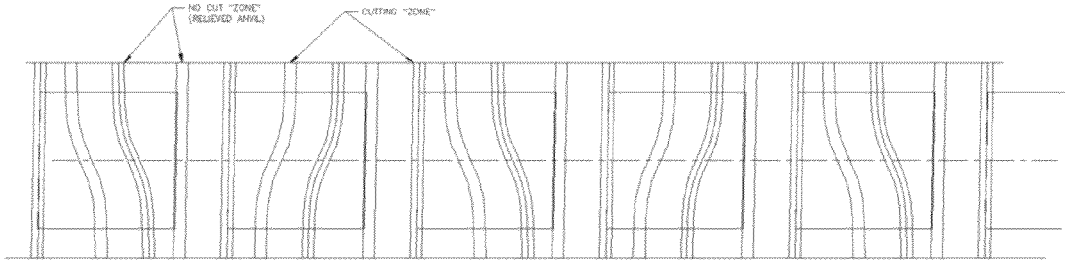
FIG. 8 is a plan view of square ear die phasing of a die of the present invention.

Referring now to FIGS. 7 and 8, plan views of shaped ear die phasing of a die of the present invention, and square ear die phasing of a die of the present invention are shown, respectively.

The shaped ear die phasing as shown in FIG. 7 corresponds with the formation of shaped ears, in which the curved blades 12 of the die 10 are aligned with the curved cutting surfaces 120 of the anvil 50. The straight blades 14 loosely mate in the recessed straight non-cutting channels 142, where no cut is effectuated in the web 30 by the straight blades 14.

The square ear die phasing as shown in FIG. 8 corresponds with the formation of square ears, in which the straight blades 14 of the die 10 are aligned with the straight cutting surfaces 140 of the anvil 50. The curved blades 11 loosely mate in the recessed curved non-cutting channels 122, where no cut is effectuated in the web 30 by the curved blades 12.

Figure 9:
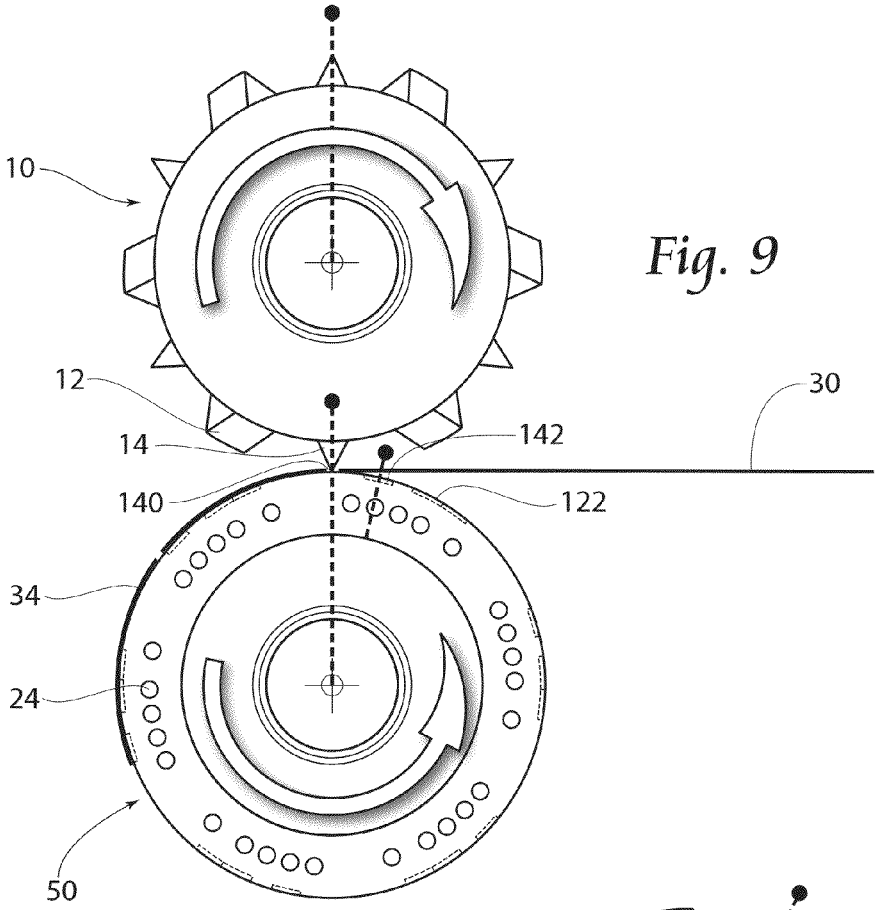
FIG. 9 is a side view of a square ear die cutting sequence, with a straight blade contacting a straight blade cutting surface.
Figure 10:
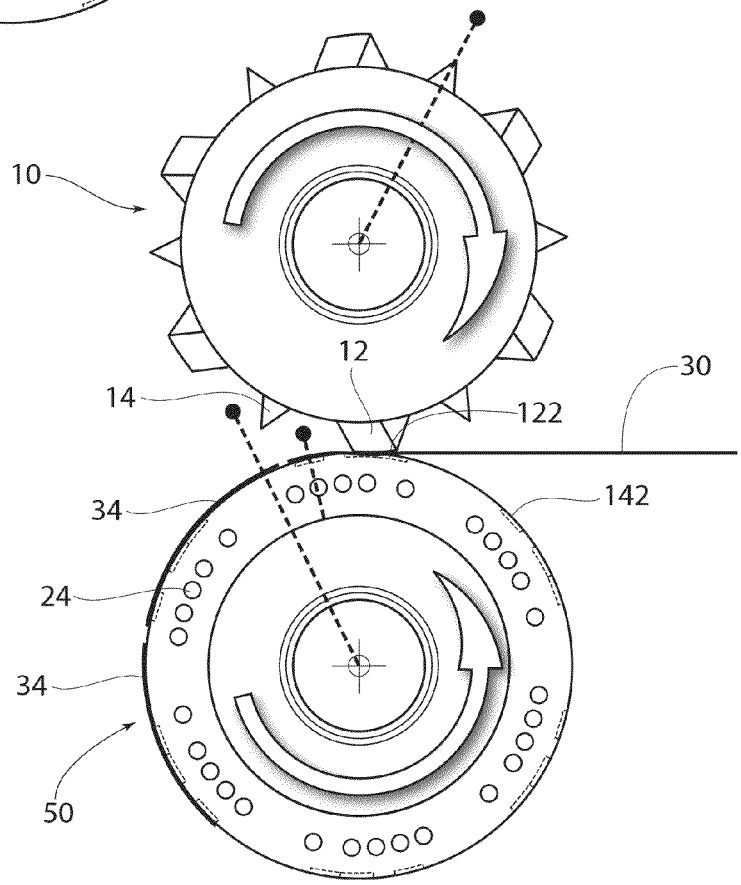
FIG. 10 is a side view of a square ear die cutting sequence during rotation, with a curved blade meeting a recessed curved non-cutting channel.

Referring now to FIG. 9, a side view of a square ear die cutting sequence is shown, with a straight blade 14 contacting a straight blade cutting surface 140 to cut the incoming web 30. Continuing through rotation, FIG. 10 shows a side view of the square ear die cutting sequence with a curved blade 12 meeting a recessed curved non-cutting channel 122, where no cut in the web 30 will be effectuated. Square ears 34 are shown departing the sequence, carried rotationally by the anvil 50, and in particular by the vacuum commutation ports 24 until picked up by downstream processing apparatus as desired (not shown).

Figure 11:
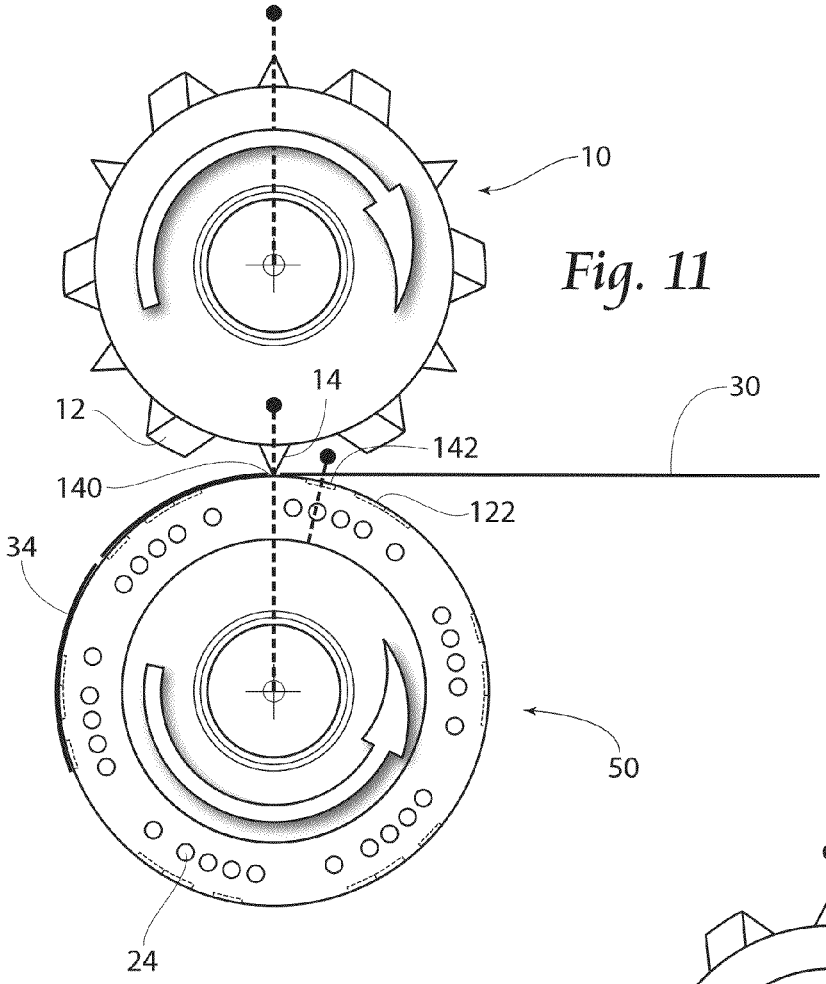
FIG. 11 is a side view of a beginning of a phase change between a square ear die cutting sequence and a shaped ear cutting sequence.

Referring now to FIG. 11, a side view of a beginning of a phase change between a square ear die cutting sequence and a shaped ear cutting sequence is shown. If a user desires to manufacture shaped ears 32, this phase change can be initiated.

Figure 12:
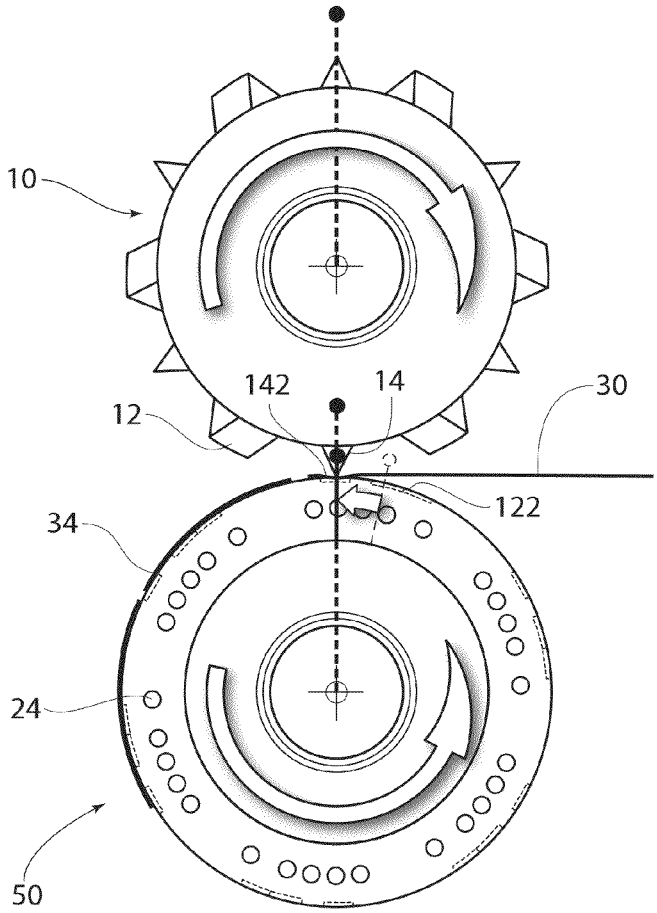
FIG. 12 is a side view following of a phase change between a square ear die cutting sequence and a shaped ear cutting sequence, with a straight blade meeting a recessed straight non-cutting channel.
Figure 13:
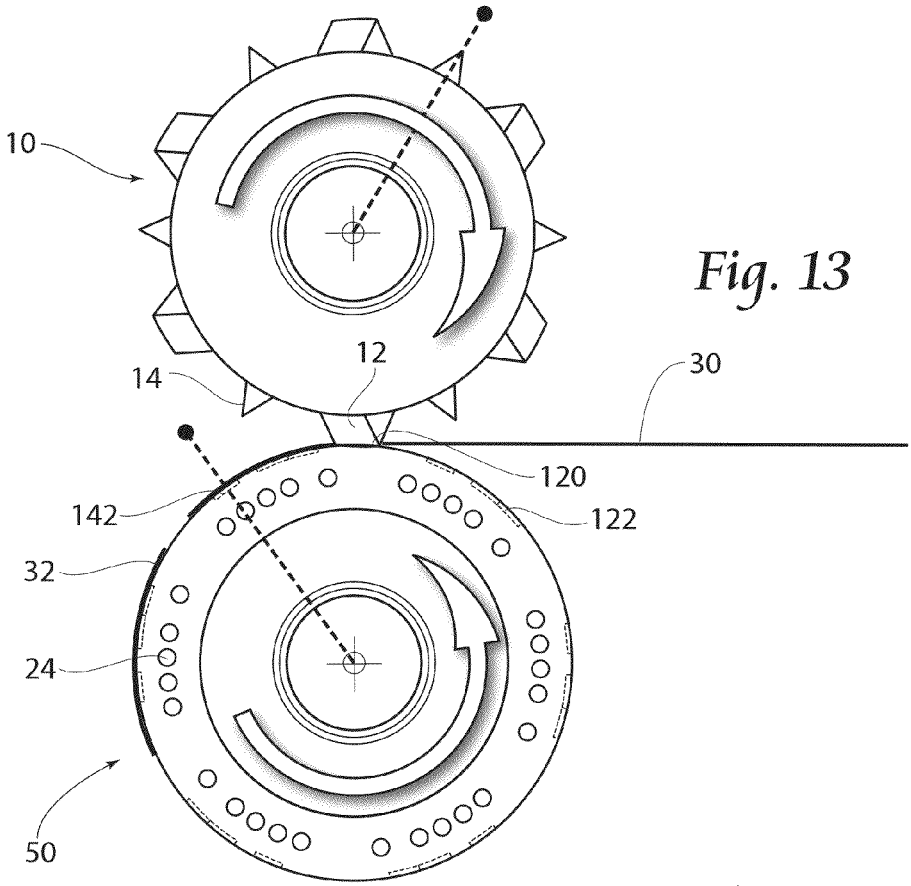
FIG. 13 is a side view of a shaped ear die cutting sequence, with a shaped blade contacting a shaped blade cutting surface.
Figure 14:
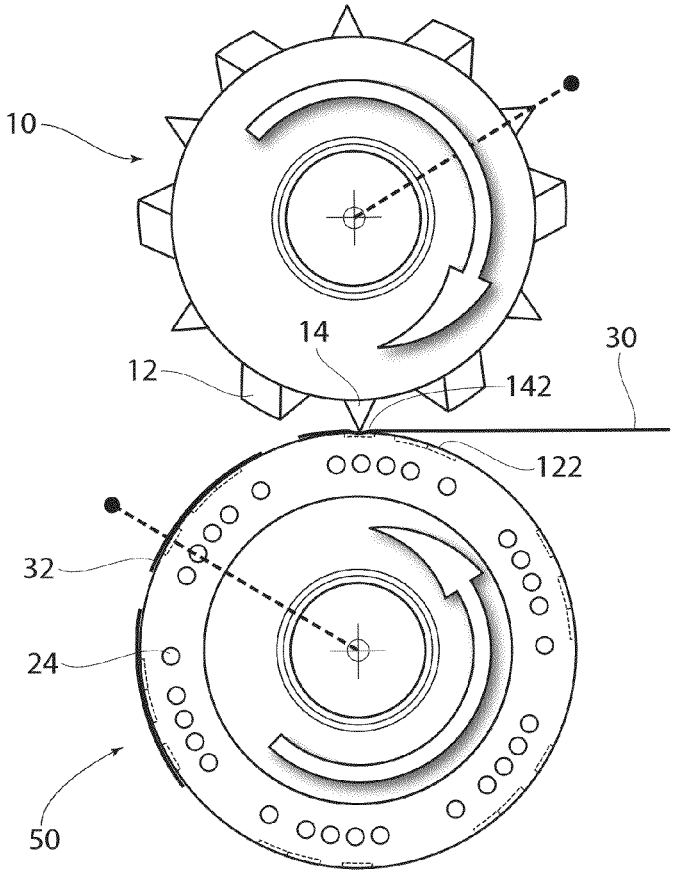
FIG. 14 is a side view of a shaped ear die cutting sequence during rotation, with a straight blade meeting a recessed straight non-cutting channel.

As shown in FIG. 12, after a phase change between a square ear die cutting sequence and a shaped ear cutting sequence, the straight blades 14 will no longer meet the straight cutting surfaces 140, but instead will meet a recessed straight non-cutting channel 142, where no cut is effectuated. Conversely, as shown in FIG. 13, during the shaped ear die cutting sequence, shaped blades 12 contact the shaped blade cutting surfaces 120 and as shown in FIG. 14 the straight blades 14, acting in a non-cutting manner, meet their respective recessed straight non-cutting channels 142.

Figure 15:
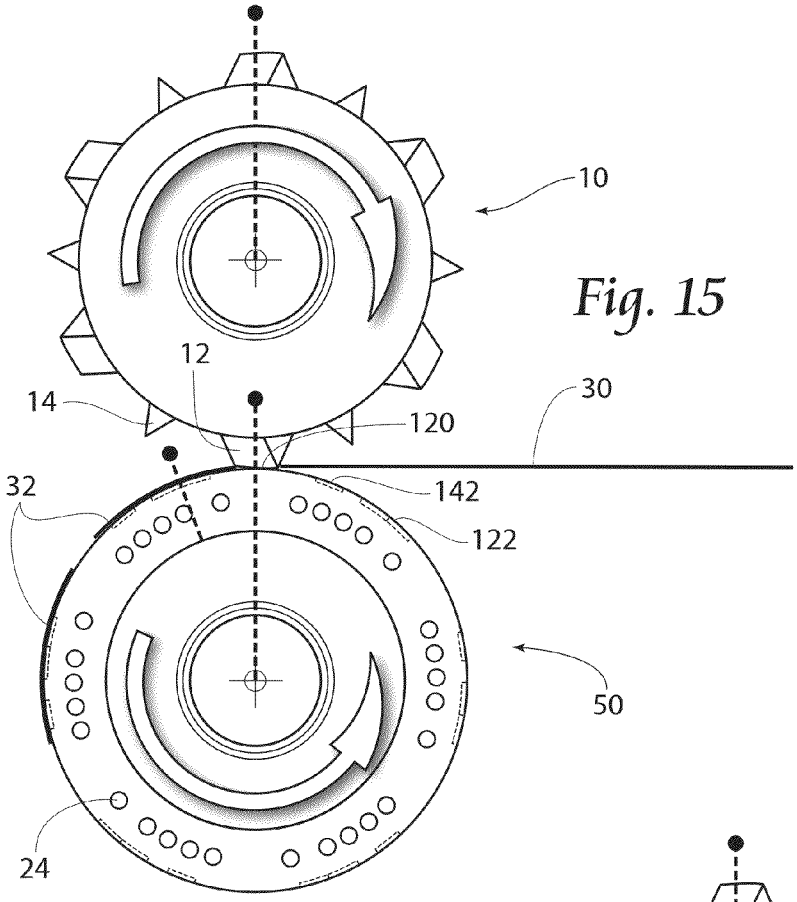
FIG. 15 is a side view of a beginning of a phase change between a shaped ear die cutting sequence and a straight ear cutting sequence.
Figure 16:
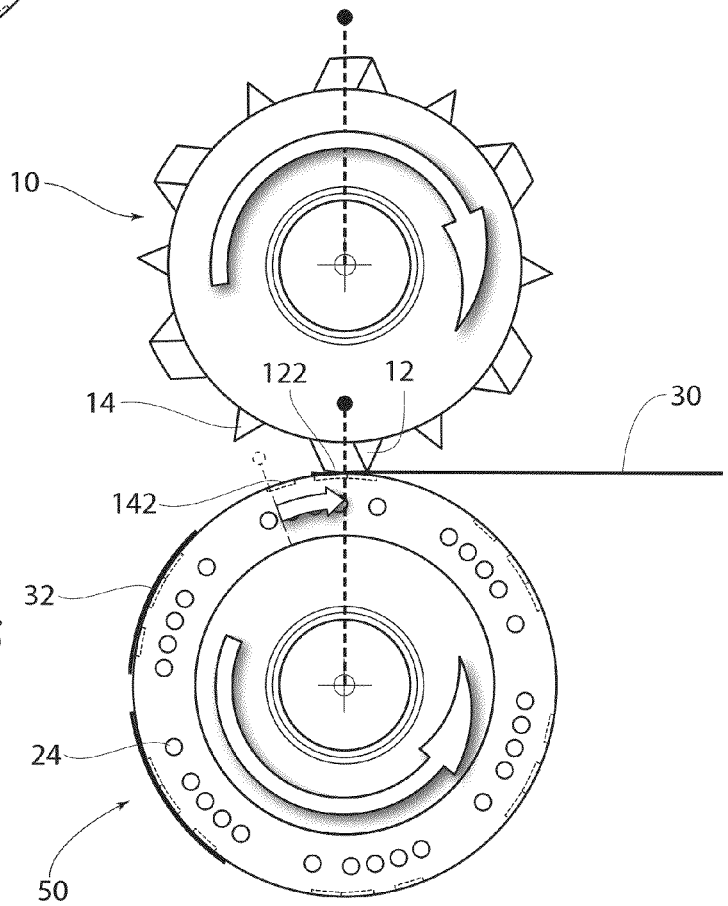
FIG. 16 is a side view following of a phase change between a between a shaped ear die cutting sequence and a straight ear cutting sequence, with a curved blade meeting a recessed curved non-cutting channel.

FIGS. 15 and 16 show a reversion of the phases, from a shaped ear die cutting sequence to the straight ear cutting sequence, where once again the curved blades 12 meet the recessed curved non-cutting channels 122, and the straight blades 14 meet the straight cutting surfaces 140.

It is noted that the invention has been described in relation to alternating straight and curved patterns, but that alternating patterns of any type (curved, straight, contoured, angled, patterned, etc) can be used, even alternating identical patterns.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A die/anvil combination comprising:

a die comprising a series of die edges;

an anvil comprising a first die edge receiving channel and a first die edge contacting surface, said channel selectively receiving said first die edge, and said first die edge contacting surface also selectively receiving said first die edge.

2. A die/anvil combination according to claim 1, said series of die edges arranged in alternating pairs of complementary edges.

3. A die/anvil combination according to claim 1, every other die edge being curved.

4. A die/anvil combination according to claim 1, every other die edge being straight.

5. A die/anvil combination according to claim 1, said anvil comprising a second die edge receiving channel and a second die edge contacting surface, said first channel receiving said first die edge while said second die edge contacting surface receiving said first die edge.

* * * * *